United States Patent [19]

Coleman et al.

[11] Patent Number: 5,009,545

[45] Date of Patent: Apr. 23, 1991

[54] WIRE MESH STRAIGHTENING METHOD AND APPARATUS

[75] Inventors: Darold D. Coleman, Rice Lake; Raymond P. Nesseth, Barron, both of Wis.

[73] Assignee: NTH, Inc., Barron, Wis.

[21] Appl. No.: 555,652

[22] Filed: Jul. 20, 1990

Related U.S. Application Data

[63] Continuation of Ser. No. 316,155, Feb. 27, 1989, abandoned.

[51] Int. Cl.[5] ..... E01C 11/16; E01C 24/04

[52] U.S. Cl. ..... 404/100; 72/164

[58] Field of Search ..... 404/100, 134; 29/33 F; 72/160, 164; 140/107

[56] References Cited

U.S. PATENT DOCUMENTS

| | | | |
|---|---|---|---|
| 1,194,641 | 8/1916 | Kitchen | 72/164 |
| 2,393,702 | 1/1946 | Naegeli | 72/160 |
| 2,460,164 | 1/1949 | Brayshaw | 72/160 |
| 2,699,196 | 1/1955 | Cuzzo | 72/160 |
| 2,750,984 | 6/1956 | Miller | 72/160 |
| 3,309,907 | 3/1967 | Steinhardt | 72/164 |
| 3,395,559 | 8/1968 | Ungerer | 72/164 |
| 3,459,027 | 8/1969 | Brownstein | 72/160 |
| 3,632,054 | 1/1972 | Heppelmann et al. | 404/100 |
| 3,638,326 | 2/1972 | Thompson et al. | 72/160 |
| 3,688,810 | 9/1972 | Spencer | 140/107 |
| 3,814,144 | 6/1974 | Spencer | 404/100 |
| 4,077,731 | 3/1978 | Holz, Sr. et al. | 404/100 |
| 4,380,921 | 4/1983 | Matsui | 72/160 |
| 4,456,399 | 6/1984 | Conover | 404/100 |
| 4,557,633 | 12/1985 | Dyck | 404/100 |
| 4,591,259 | 5/1986 | Kuo et al. | 72/160 |
| 4,594,872 | 6/1986 | Nordlof | 72/164 |

*Primary Examiner*—Ramon S. Britts
*Assistant Examiner*—Gay Ann Spahn
*Attorney, Agent, or Firm*—Merchant, Gould, Smith, Edell, Welter & Schmidt

[57] ABSTRACT

An improved automated wire mesh straightening apparatus is described. Wheels, casters and a jack enable ease of mobility, jockeying and leveling respectively of the apparatus at a construction site. Hydraulic operation of moving parts provides general fail-safe operation of the apparatus which is also otherwise designed with operator safety in mind. Rolled wire mesh is automatically straightened by a unique application of drive, nip and reaction forces that can be rapidly adjusted to completely straighten wire mesh of varying gauge and under varied environmental conditions.

29 Claims, 6 Drawing Sheets

FIG. 4
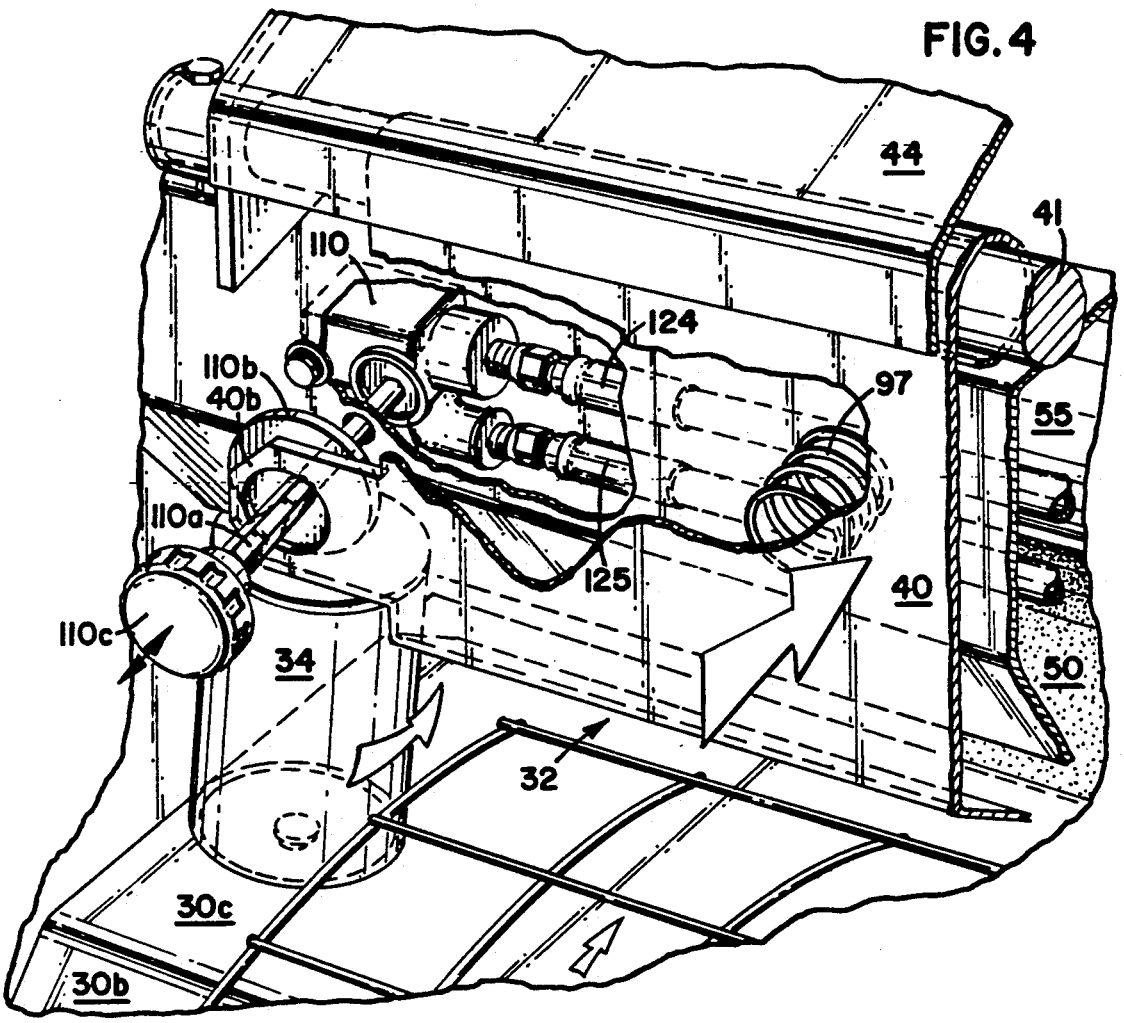
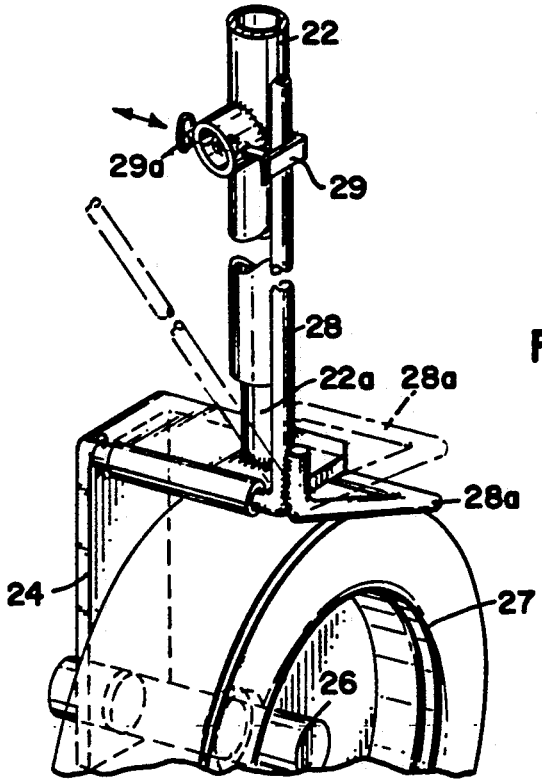
FIG. 6

WIRE MESH STRAIGHTENING METHOD AND APPARATUS

This is a continuation of application Ser. No.316,155, filed Feb. 27, 1989, which was abandoned upon the filing hereof.

FIELD OF THE INVENTION

This invention relates generally to construction power equipment, and more particularly to a mobile apparatus for automatically straightening rolled wire mesh of the type used for concrete reinforcement of paved roadbeds.

DESCRIPTION OF THE PRIOR ART

Concrete pavement and decks often include a wire mesh reinforcement material which is embedded within the concrete at the time of pouring the concrete. To provide maximum reinforcement, the reinforcing mesh should preferably be evenly spaced from the ground when pouring the concrete so as to be uniformly positioned when viewed in cross section, generally near the center of the hardened concrete. Uneven positioning of the reinforcing mesh within the concrete can result in wide variations in the strength of the concrete over the reinforced areas.

Such reinforcing mesh is typically shipped to the construction site in large rolls, and must be unrolled and positioned within the bed in which the concrete will be poured or laid. Due to the wire resiliency and its tendency to retain its "rolled" curvature, it has been very difficult and often virtually impossible to get the curvature out of the wire and to position such wire mesh evenly and flat within the formed bed. Many man hours of time and frustration are typically expended in unrolling and partially straightening and pulling the wire prior to pouring of the concrete. Even the best manual straightening efforts generally leave a situation wherein the wire extends in wave-like manner along its length. The problem becomes even more acute as the thickness of the wire increases and as the end of a wire roll is unwound, since the radius of curvature of the wire decreases at its "inside end," making the wire much more difficult to straighten. It has become commonplace in the industry to wastefully cut off and simply discard the last four to six feet of mesh near the end of a roll, rather than to expend the time and effort in straightening the end of the roll. The problem is further accentuated in colder weather wherein the wire resiliency significantly decreases.

Heretofore, there have been no practical or economical methods or apparatus for automatically straightening rolled reinforcing mesh wire at the construction site. Attempts at hand straightening, pulling and bending of such wire have proven less than satisfactory, most often resulting in uneven, over or under bending, kinking and buckling of the wire. It would be desirable, therefore, to have an automated power operated straightening device that is easily portable and usable at the construction site for uniformly and rapidly straightening entire rolls of reinforcing mesh wire. Such a device must above all, be operator safe and incorporate fail-safe safety features that allow a user to instantaneously stop or disengage dangerous moving parts of the machine should an operator or user get entangled with or otherwise drawn into the apparatus processing the wire mesh.

One type of automated apparatus known in the art removed kink and bends from wire mesh by compressing the wire mesh between a pair of opposed driven rollers of the type used in the agricultural industry for crushing hay. While this technique represented a significant improvement over prior hand straightening methods, it did not incorporate the safety or convenience features required to make it practical for use in the construction industry. Further, the basic roller straightening technique did not completely take the curvature out of a prerolled wire mesh and did not provide adjustment compensation techniques for rapidly adjusting to wire mesh thicknesses of varying gauge. Such apparatus was also dangerous to the operator who was required to manually assist in the feeding of the wire mesh into the rollers, and did not incorporate fail-safe safety features that enabled an operator to immediately stop the rollers in the event he became entangled or caught in the wire mesh or feed mechanism.

The present invention addresses and satisfies the above-noted prior art shortcomings and needs in the industry for an automated mesh straightening apparatus by providing a simple, reliable and effective mesh straightening apparatus that can be easily moved to the desired construction location and safely operated by a single person.

SUMMARY OF THE INVENTION

The present invention provides a compact wire mesh straightening apparatus particularly suitable for on-site straightening of rolled wire mesh of the type used in reinforcing concrete beds. Typically such mesh comes in 150 foot rolls in five-foot widths. Its applicability to construction site use is provided in part by the fact that the straightening apparatus is mounted on an axle and wheels so as to be easily towed by a motor vehicle. It also has a third caster wheel and handle assembly mounted on a manually operable screw jack that enables the apparatus to be rapidly jockeyed in dolly-like fashion into the desired position at the construction site. The jack also enables rapid leveling of the straightening apparatus. In the event that heavier equipment such as cranes are available at the construction site, the apparatus includes a lifting bracket that enables the entire apparatus to be lifted into, for example, a pickup truck or to other elevated positions generally directly inaccessible by motor vehicle. The apparatus further includes a brake locking mechanism that is operable to prevent movement of the apparatus once established in operative position.

Besides its mobility and compactness features, the invention addresses operator safety. A fail-safe hydraulic operating system is used that automatically removes power from the straightening drive members in the event of hydraulic failure and provides for a safety stop switch mechanism that instantaneously stops the system drive rollers in the unlikely event that a person were to be drawn toward the inlet of the apparatus. To further ensure operator safety, the apparatus is designed to be operated by a single operator, and all of the controls needed to operate the apparatus are located on the side of the apparatus in a manner which ensures that the operator stands clear of the advancing wire mesh and the moving parts of the apparatus. In such position, the operator also has a clear line of sight to both the inlet and the outlet portions of the apparatus enabling him to safely operate the apparatus if others are assisting him.

A preferred embodiment of the invention employs a power lift feature for automatically lifting the roll of wire mesh to be straightened, into a position such that the wire naturally feeds into the inlet port of the straightening apparatus. The mesh to be straightened is unwound from the top of a roll which enables an automatic self-releasing starting lever to engage and draw the mesh toward the inlet port without operator intervention. The wire mesh is drawn through a nip formed by a pair of rollers which compressively remove kinks and irregularities generally across the plane of the mesh as it passes through the nip. The compressive force at the nip as well as the interroller spacing at the nip can be adjusted, and the operator can entirely release pressure at the nip by lifting one of the rollers from the nip area by means of a safety lever arrangement. The mesh is directed from the nip toward a reaction surface, the angle of which can be varied relative to the advancing wire, which bends the mesh in a direction opposite to the curvature it has as it leaves the roll. The adjustment features provided by the invention enable a reverse curvature to be applied to the roll which is exactly equal to its preexisting curvature, such that the wire is completely straightened. The mesh straightening apparatus of this invention enables the entire wire mesh roll to be straightened, avoiding the waste heretofore encountered with prior art straightening techniques.

Therefore, according to one aspect of the invention, there is provided a wire mesh straightening apparatus for automatically straightening rolled wire mesh at a construction site which includes: (a) a chassis that is sized and configured for ease of mobility to and at a construction site; (b) a pair of generally parallel rollers mounted to the chassis and cooperatively aligned generally parallel to each other to form a nip between their respective surface portions that lie closest to one another, wherein the rollers are at least as wide as the width of the wire mesh to be straightened; (c) means for advancing the wire mesh to be straightened through the nip formed by the rollers including hydraulic drive means operatively connected to drive at least one of the rollers about its axis; and (d) reaction means arranged and configured to intercept the wire mesh passing through the nip for continuously bending the mesh in a direction opposed to the preexisting curvature of the wire mesh as it enters the nip, whereby the wire mesh is straightened as it leaves the reaction means.

According to another aspect of the invention there is provided a method of straightening rolled wire mesh comprising the steps of: (a) positioning a roll of wire mesh to be straightened adjacent and in generally parallel manner to a pair of generally horizontal rollers cooperatively arranged to form a nip therebetween such that the wire unrolls from the top of the roll; (b) lifting the roll of positioned wire mesh from the ground and such that the wire leaving the roll is generally aligned with said nip, without requiring bending of the wire to enter the nip; (c) continuously advancing the wire through the nip by hydraulically rotating at least one of said rollers; thereby removing kinks and irregularities therefrom; and (d) continuously bending the wire advanced through said nip in a direction opposed to the direction of travel of said wire from said nip, thereby straightening said wire.

According to yet another aspect of the invention there is provided a method of automatically and continuously straightening rolled wire mesh comprising the steps of: (a) horizontally arranging a roll of wire mesh to be straightened such that the wire will be unwound from the top of the roll; (b) guiding the wire mesh unwound from the roll through a nip formed by a pair of cooperatively arranged rollers; (c) compressively engaging the wire mesh between said rollers at said nip; (d) rotating at least one of the rollers by means of a closed hydraulic power system thereby advancing the wire mesh through the nip; (e) directing the advancing wire mesh from said nip toward a reaction surface; (f) continuously pushing said directed wire mesh against and along said reaction surface mounted at a predetermined angle relative to the advancing wire mesh, thereby imparting a reverse curvature to said wire mesh generally opposite to that which it retained upon removal from said roll; and (g) automatically stopping rotation of said one roller upon a pressure failure in said hydraulic system.

While the present invention will be described with respect to its applicability to straightening reinforcing wire mesh of the type used to reinforce concrete, it will be understood that the invention is not limited to use with such reinforcing wire mesh, but could be used to straighten any type of rolled wire mesh product. Further, while the invention will be described with respect to a particular embodiment which has a uniquely looking form and shape, such aesthetic features are not to be construed as limiting to the invention. Further, the preferred embodiment of the invention will be described with reference to particular components and parts. It will be readily understood by those skilled in the art that other components and parts or variations thereof could equally well be used to achieve the claimed functions. These and other variations in the manner and technique of implementing the invention will readily be recognized by those skilled in the art.

BRIEF DESCRIPTION OF THE DRAWING

Referring to the Figures, wherein like numbers represent like parts throughout the several views:

FIG. 4 is an enlarged fragmentary perspective view of the left portion of the emergency stop panel of the apparatus shown in FIG. 1 illustrating the apparatus for actuating the primary safety stop switch;

FIG. 6 is an enlarged fractional view of the caster wheel and brake portion of the apparatus of FIG. 1.

DESCRIPTION OF THE PREFERRED EMBODIMENT

Figure 1:
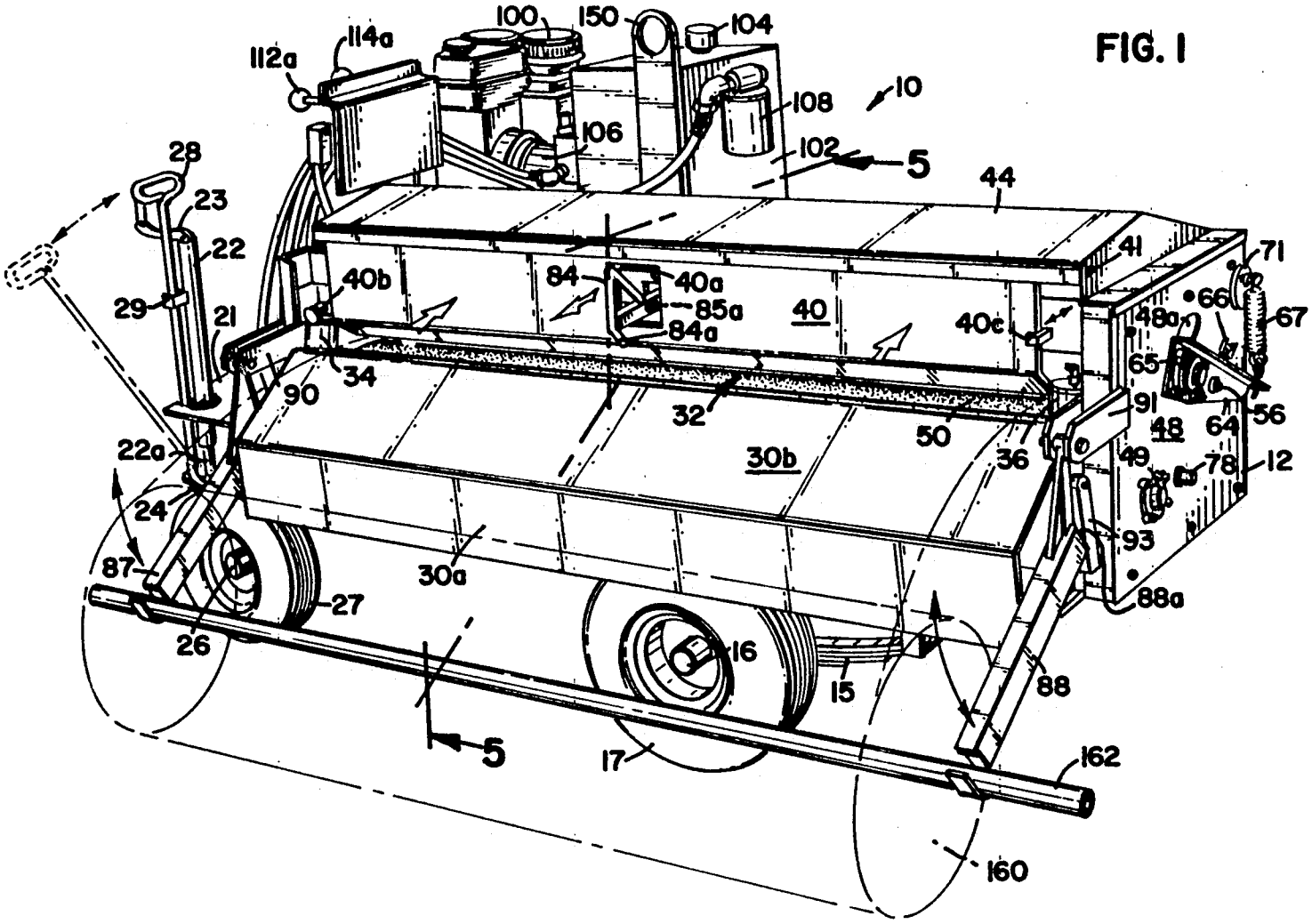
FIG. 1 is a perspective view of a mesh straightening apparatus constructed according to the principles of this invention viewed from the front, top and right end thereof.
Figure 2:
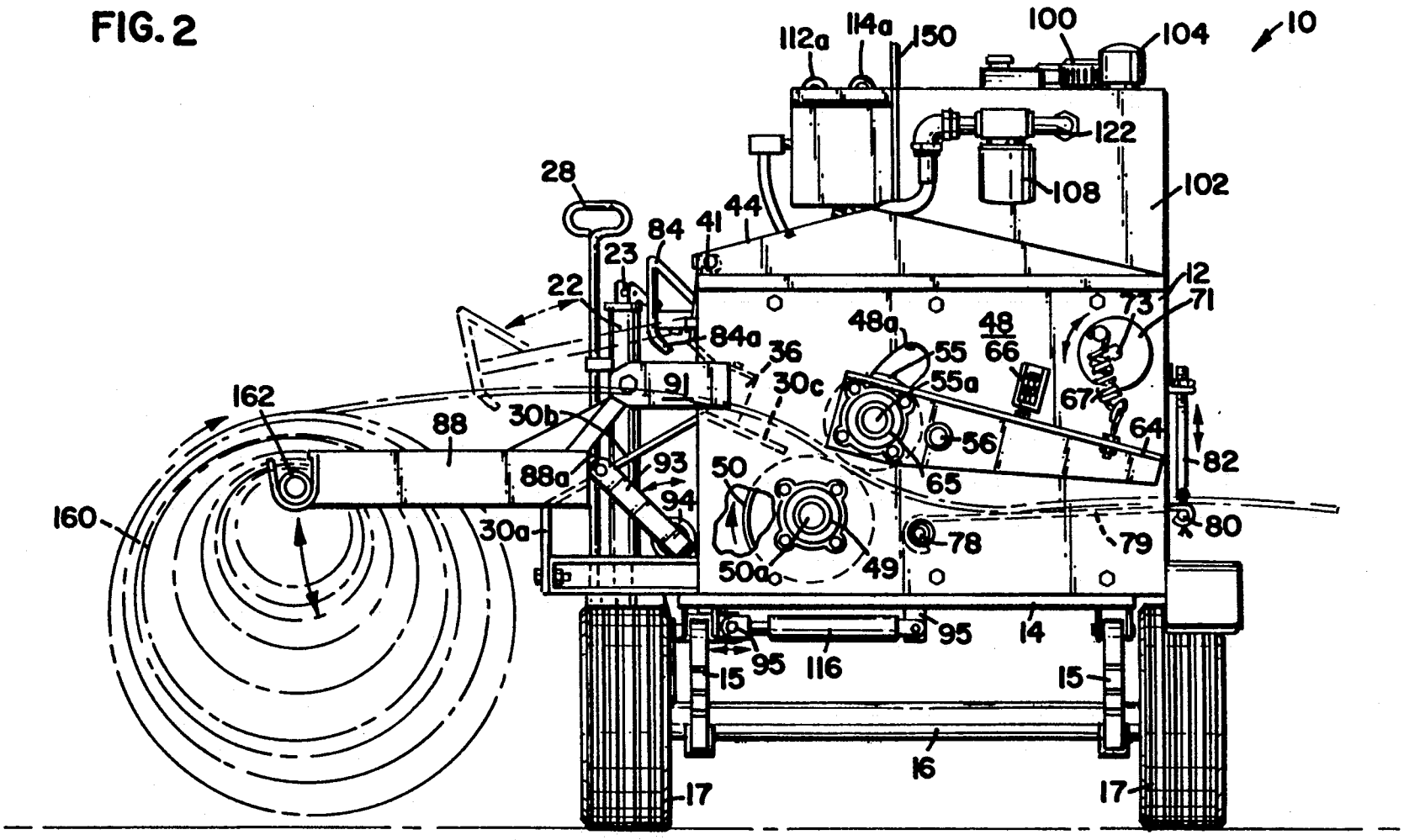
FIG. 2 is a right end elevational view of the mesh straightening apparatus of FIG. 1.
Figure 3:
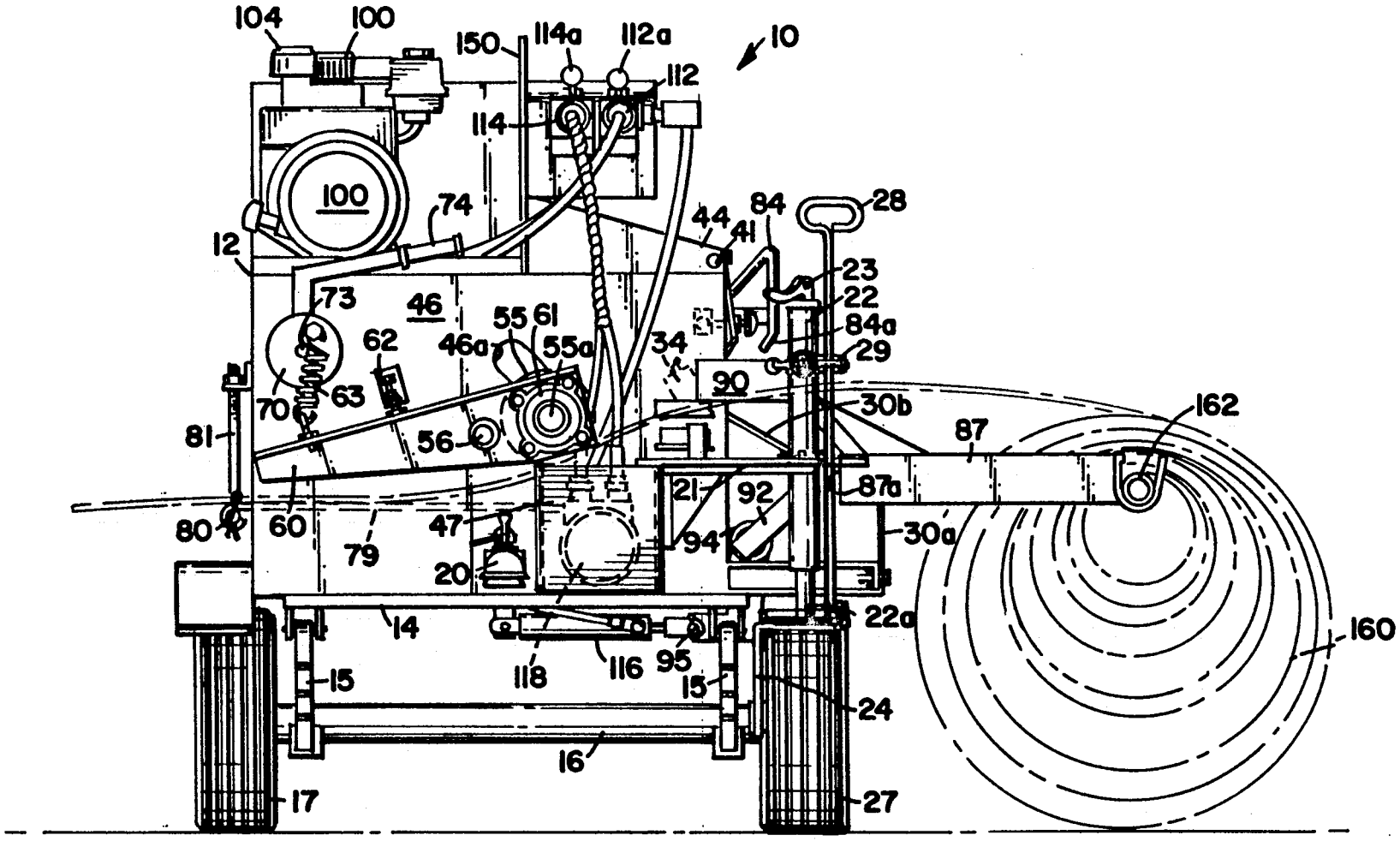
FIG. 3 is a left end elevational view of the mesh straightening apparatus of FIG. 1.

The Drawing illustrates one preferred embodiment of a wire mesh straightening apparatus constructed according to the principles of this invention. Referring to FIGS. 1, 2 and 3 there is generally shown at 10 a mesh straightening apparatus having an upper chassis structure 12 mounted to a lower support framework, generally designated at 14. The lower support frame 14 is mounted by means of a pair of springs 15 in a manner well-known in the art to a primary axle 16, the ends of which operatively carry a pair of wheels and tires, generally designated at 17. One end of the frame (FIG. 3) forms a tongue and conventional trailer hitch connector, generally designated at 20, which enables the entire apparatus to be towed by a motor vehicle in conventional manner.

The forward end of the chassis also includes a mounting bracket 21 to which is connected a caster wheel support jack 22. The caster support jack 22 has a movable internal sleeve member **22*a* telescopically inserted and threadably secured within the external housing of the jack 22 so as to be vertically raised and lowered in response to rotation of a crank handle 23 disposed at the upper end of the jack 22, in a manner well-known in the art. The lower end of the vertically movable jack member 22*a* is pivotally connected to an axle support assembly, generally illustrated at 24 (FIG. 6) for rotatable caster-like motion about the axis of the support jack 22. A second axle 26 and caster wheel and tire 27 are operatively mounted to the caster support bracket 24. When the mesh straightening apparatus 10 is not connected to a towing vehicle by means of the trailer hitch assembly 20, the caster wheel 27 can be lowered by means of the caster wheel support jack 22 to provide support and leveling action for the forward end of the apparatus. When the apparatus 10 is being towed, the caster wheel 27 is simply lifted off of the ground by means of the jack assembly 22**.

Figure 5:
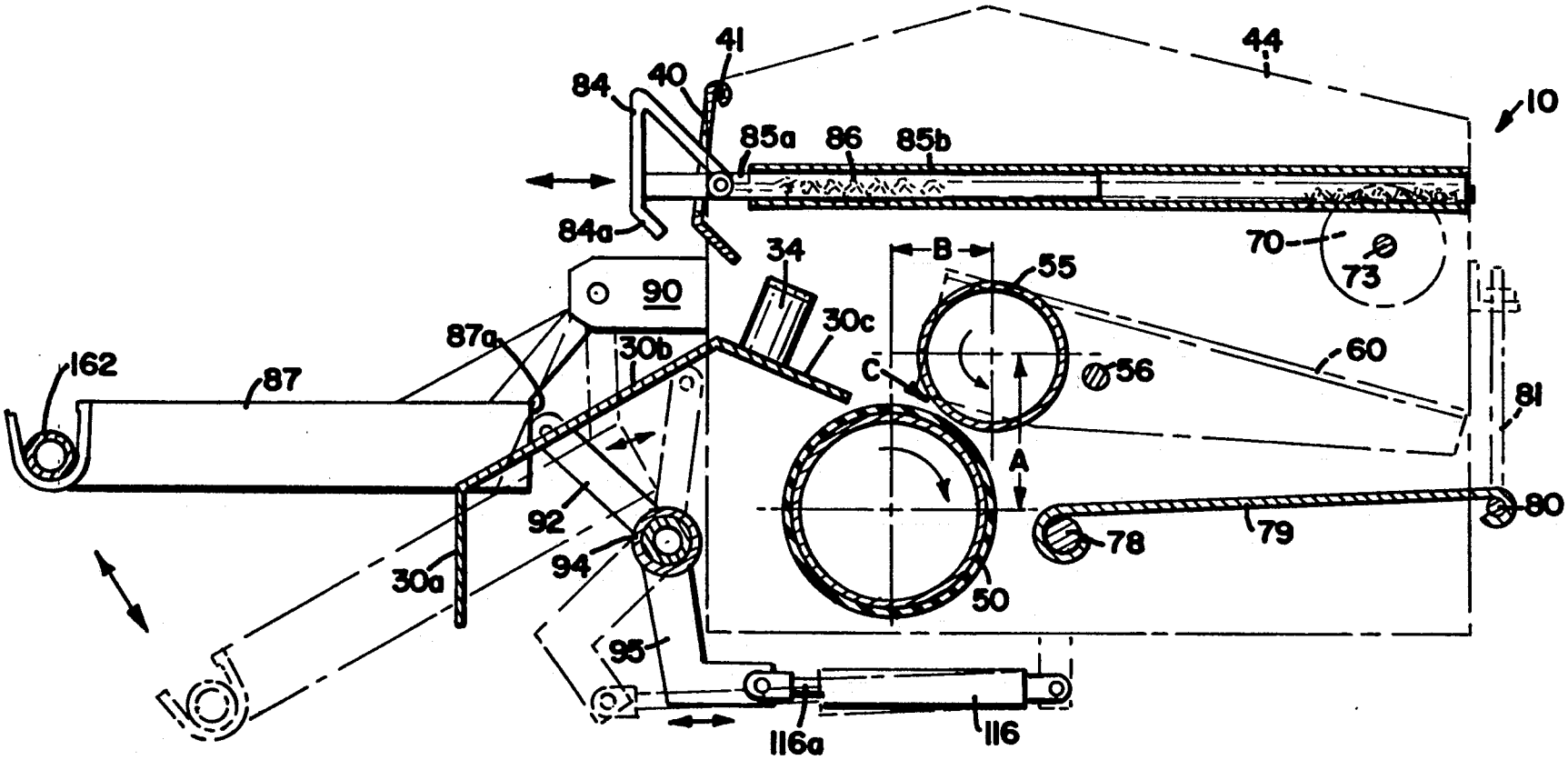
FIG. 5 is a cross sectional view generally taken along the Line 5—5 of FIG. 1.

In the preferred embodiment, the caster wheel 27 is generally aligned with one of the primary wheels 17 as is best illustrated in FIGS. 2 and 3. A handle 28 is pivotally connected to the caster bracket member 24 adjacent its forward end (as best illustrated in FIGS. 1 and 5) to enable ease of movement of the mesh straightening apparatus in wagon or dolly-like fashion at a construction site. When the handle 28 is extended in a forward manner such as illustrated in dashed lines in FIG. 1, the caster tire 27 is free to rotate and move along the ground or support surface upon which the caster wheel 27 and primary wheel 17 rest. The lower end of the handle has a rigid extension bar **28*a* (FIG. 6) which pivots about the horizontal connection axis of the handle 28 with the caster support bracket 24 in a manner such that when the handle 28 is "lowered" as shown in dashed lines in FIG. 1, the rigid extension bar pivots in an upward direction away from the tread of the caster wheel 27. However, when the handle 28 is lifted to an upright or vertical position, as shown in solid lines in FIGS. 1 and 6, the rigid extension bar 28*a* pivots downwardly into frictional engagement with the tread of the caster wheel 27, to prevent the caster wheel from turning, thereby acting as a locking brake for the caster wheel. The handle 28 is positioned in such brake-lock position during operative use of the mesh straightening apparatus, as hereinafter described in more detail. A handle lock or clamp, generally designated at 29 secures the handle 28 in an upright position. The locking clamp 29 has a U-shaped channel mounted to the outer housing of the support jack 22 which forms a seat for the elongate handle portion of the handle 28, and a retaining spring-biased pin 29*a* which is disposed across and closes the open end of the U-shaped channel. The handle 28 is locked or released from locked position in the clamp by simply operating the spring-biased pin 29*a***.

The input or wire feed side of the apparatus, generally designated as the "front" side, is illustrated in FIG. 1. A first front panel 30 protectively shields a drive roller 50, hereinafter described in more detail, and is securely mounted to the support framework 14. The panel 30 has a lower generally vertical portion **30*a*, a first upper portion 30*b* inclined inwardly and upwardly toward the drive roller 50, and a second upper portion 30*c* which extends from the first upper portion 30*b* and extends inwardly and downward toward the drive roller 50. The inclined surfaces 30*b* and 30*c* form an input guide surface for the wire mesh to be straightened. The upper inclined guide surface 30*c* terminates at an inlet feed port, generally designated at 32, for directing wire mesh between the lower drive roller 50 and an upper roller 55, to be described in more detail hereinafter. A pair of outer guide rollers 34 and 36 vertically mounted at each end of the inclined guide surface 30*c* are rotatable about generally vertical axes and function to guide and contain wire mesh fed into the input feed port 32 from lateral shifting movement. Each of the guide rollers 34 and 36** has in the preferred embodiment a grease fitting at its upper end for lubricating the rollers.

The upper roller 55 and the upper portion of the chassis 12 is enclosed by an emergency stop panel 40 and a top cover 44. The emergency stop panel 40 is pivotally mounted to an upper cross bar support 41 transversely extending between the forward and trailing ends of the apparatus. The emergency stop panel 40 downwardly hangs from its support member 41 in protective fashion in front of the upper roller 55, with its lower edge being bent slightly inward toward the roller 55 and defining the upper boundary of the inlet feed port 32. The emergency stop plate 40 defines a rectangular opening **40*a* near its center, and further has a laterally projecting lever arm 40*b* extending from its left edge (as viewed in FIGS. 1 and 6) for engaging an emergency stop valve 110, hereinafter described in more detail. The top cover panel 44 extends backwardly from the support bar 41 to prevent access to the rollers 50 and 55 from the front and top of the apparatus, except through the inlet feed port 32**.

Referring to FIG. 3, the forward end of the mesh straightening apparatus 10 is closed by means of an end plate member generally designated at 46. The trailing end of the apparatus, illustrated in FIG. 2, is similarly closed by an end plate member 48. End plates 46 and 48 are appropriately secured to the framework 14 and also support and are fastened to the top cover 44. The upper cross bar support 41 extends between and is mounted to the opposed end plates 46 and 48. While a matter of design choice as dictated by the width of wire to be straightened, in the preferred embodiment, the width of the inlet port is sized to accommodate a wire mesh roll five feet wide. The primary drive roller 50 is transversely mounted to extend across the inlet feed port 32. The axle **50*a* of roller 50 is mounted at the trailing end to the end plate 48 by means of a bearing assembly generally illustrated at 49 and to the forward end plate 46 by means of a similar bearing assembly (not illustrated). The axle 50*a* of drive roller 50 projects through the bearing assembly of the forward end plate 46 and is operatively coupled to and for movement with the drive shaft of a hydraulic motor 118, illustrated in phantom in end view in FIG. 3, which is protected by a plate member 47. A second cross bar support shaft 56 extends between and is securely mounted to the end plates 46 and 48 and is aligned parallel to the axis 50*a* of the drive roller 50. The respective ends of the support shaft 56 project through and extend slightly beyond the outer surfaces respectively of end plates 46 and 48. End plates 46 and 48 respectively define elongate openings 46***a* and 48*a*, arcuately shaped relative to the central axis of support shaft 56.

First and second roller mounting levers 60 and 64 respectively, are pivotally mounted to the projecting end portions at opposite ends of the support shaft 56, as illustrated in FIGS. 2 and 3, for pivotal rotation about the axis of support shaft 56 adjacent the outwardly directed surfaces of the end plates 46 and 48. The mounting levers 60 and 64 are secured to the support shaft 56 by an appropriate bearing and nut arrangement. Those end portions of the roller support lever members 60 and 64 disposed toward the front or wire mesh feed side of the apparatus 10 have roller bearing support members 61 and 65 respectively secured thereto for mounting the upper roller 55 in a manner such that the ends of the central support axle 55*a* of the roller 55 freely pass through the elongated slots 46*a* and 48*a* in the end plates 46 and 48 when the roller support levers 60 and 64 are pivoted, and such that the roller axis 55*a* is aligned parallel with the axis 50*a* of the drive roller 50.

As illustrated in FIGS. 2, 3 and 5, the position of the upper roller 55 can be pivotally adjusted relative to the primary drive roller 50 by pivoting of the roller support levers 60 and 64 about their common pivot axis 56. Depending upon the thickness or gauge of the wire mesh being handled, the pivotal position of the lever support arms 60 and 64 may be adjusted such that the respective surfaces of rollers 50 and 55 actually engage one another, or, preferably, are spaced slightly apart from one another. A pair of adjustable stop members 62 and 66 are respectively mounted to the end plates 46 and 48 and are positioned to engage the upper surfaces of the roller support levers 60 and 64 respectively so as to adjust the minimum interroller spacing at the nip formed by the cooperating rollers 50 and 55.

A pair of springs 63 and 67 are respectively secured to the nonroller-supporting ends of the levers 60 and 64 for cooperatively biasing the lever members about their pivot axis 56 and toward engagement with the adjustable stop members 62 and 66 respectively. The springs 63 and 67 cooperatively provide a downward biasing force through the lever arms 60 and 64 to the upper roller 55 to counteract any forces imparted to the roller 55 which would tend to lift the roller in an upward direction. The upper ends of the springs 63 and 67 are respectively secured to a pair of eccentric cam plates 70 and 71 which are rotatably mounted for common movement with a shaft 73 laterally extending across the chassis 12 and secured through the end plates 46 and 48. The cam members 71 and 73 and shaft 73 are rotated by means of an operating lever 74 which is directly connected to the cam 70. As illustrated in FIG. 3, when the operating lever 74 is rotated in the clockwise direction, the cams 70 and 71 move in an upward direction to stretch the springs 63 and 67, thereby exerting a downward biasing force on the upper roller 55 through the respective lever arms 60 and 64. Conversely, when the operating lever 74 is moved in a counterclockwise direction (as viewed in FIG. 3), the springs 63 and 67 relax, thereby relieving tension and enabling the upper roller 55 to move out of engagement and in an upward direction away from engagement with the lower roller 50.

In the preferred embodiment, the lower drive roller 55 is made of steel and is coated with 0.5 inches of rubber, and has an overall diameter of nine inches. The upper roller 55 is also made of steel and has a diameter of six inches. The vertical dimension "A" of FIG. 5 between the respective axes 50*a* and 55*a* is seven inches, and the horizontal interaxis spacing (dimension "B" in FIG. 5) is three and one-half inches. The offset positioning of the upper roller axis 55*a*, rearward with respect to the axis 50*a* of the lower roller (FIG. 5) causes wire mesh engaged at the nip of the rollers to curve downward from the nip to the shelf or plate 79 (as hereinafter described in more detail). Placement of the upper roller 55 by the support lever arms 60 and 64 preferably is such so as to leave a one-eighth inch spacing between the respective surfaces of the rollers 50 and 55 at their nip line ("C" in FIG. 5).

A fourth support shaft 78 transversely extends between and is mounted to the end plates 46 and 48 and is generally aligned in parallel with the axes of the upper and lower rollers 50 and 55 and lies proximate to the lower roller 50. One end of a shelf or plate 79 is pivotally secured to the support rod 78 proximate the drive roller 50, as shown in FIG. 5, such that the upper surface of the plate 79 is generally at the same vertical height as the axis 50*a* of the drive roller 50. The opposite, distal end of the shelf or plate 79 is supported by another transversely extending support rod 80, the ends of which are carried by to a pair of adjustable bracket members 81 and 82 which are connected respectively to the end plates 46 and 48 for adjusting the vertical position of the distal end of the plate member 79. The upper surface of the plate 79 forms a reaction or bending surface for intercepting wire mesh passing between the rollers 50 and 55.

The anchor positions of the springs 63 and 67 on the cams 70 and 71 are off-center or eccentric in nature such that the operating lever 74 has a "rest" position either in its upright position or in its lowermost position. Between the two "rest" positions there is a spring tension from the springs 63 and 67 transmitted through the lever 74 which must be overcome by the operator. Therefore, before the upper roller 55 can be placed in operative (nip forming) position adjacent the lower roller 50, the operator must make a conscious decision, and must actually place roller 55 in operative position by moving lever 74 to its uppermost "rest" position. Placing lever 74 on the side of the apparatus provides another degree of safety in that the operator is forced to move away from the front or wire mesh "feed" side of the machine when he operates lever 74. The spring-/lever arrangement of the arms 60, 64 and springs 63, 67 is designed in the preferred embodiment to place approximately 1000–1400 pounds of pressure on the upper roller 55 for straightening wire at the nip line. This force has been found to be more than adequate to remove bends and kinks from wire mesh typically used for concrete reinforcement purposes, at a typical processing speed of two lineal feet per second.

The handle portion 84 of a wire engaging and feed arm apparatus projects through the opening 40*a* formed in the emergency stop panel 40. The lower portion of the handle 84*a* is bent toward the wire mesh input feed port 32 and forms a self-releasing hook for engaging the wire mesh to be straightened by the apparatus 10. The handle 84 is connected to an elongate inner tubular portion 85*a* which cooperatively slides within an outer sleeve member 85*b*, mounted within the chassis 12 above the upper roller 55. A spring 86 housed within the tubular members 85*a* and 85*b* connects the handle 84 and inner tube 85*a* to the rear of the chassis 12 so as to provide bias to the handle 84 in a direction which tends to retract the handle back toward the opening 40*a* when pulled outwardly therefrom.

The preferred embodiment of the invention also includes a power lift feature for automatically raising a roll of wire mesh to be straightened from the ground such that the top of the wire roll from which the mesh is being unwound generally aligns with the input feed port 32 of the wire straightening apparatus (as illustrated in FIGS. 2 and 3). It will be understood by those skilled in the art that since the wire feed to the inlet port 32 comes from the "top" of the roll (FIGS. 1-3), the wire roll does not have to be lifted very far from the ground and could also easily be performed manually by an operator who could load the wire roll onto the unwinding dowel or spool by lifting the loaded spool into position, one end at a time. The mesh lifting apparatus includes a first pair of lifting arms 87 and 88 pivotally mounted to a pair of support brackets 90 and 91 which are respectively welded to the end plates 46 and 48. The free end of each of the wiring lifting arms 87 and 88 defines an upwardly facing "U-shaped" bracket sized to accommodate a spool member 162 that can be inserted through the center of a wire mesh roll 160, for lifting the roll. The back surfaces 87*a* and 88*a* of the lifting arms define cam surfaces, hereinafter described in more detail. The lifting arms 87 and 88 may be manually pivoted upwardly such that the support arms 87 and 88 engage the upper portion of the chassis 12 wherein they are out of the way for storage purposes or when the mesh straightening apparatus is being towed or otherwise moved.

The lifting arms 87 and 88 are operatively movable, under hydraulic power, between a wire feed position (illustrated in bold lines in FIG. 5) and a loading position (illustrated by phantom lines in FIG. 5), by means of a pair of cam members 92 and 93, which engage and move the lifting arms 87 and 88 respectively by forces exerted on the cam surfaces 87*a* and 88*a* respectively. The movable cam members 92 and 93 are secured to a rotatable shaft 94 which is operatively mounted to the frame 14 below the lower panel 30, as illustrated in FIG. 5. The shaft 94 is rotated about its axis by means of a lever arm 95 which is driven by a hydraulic piston 116. The piston 116 is secured to the frame 14 such that when the piston is operated so as to move its piston arm 116*a*, the lever arm 95 moves so as to rotate the shaft 94 and its associated cams 92 and 93 so as to appropriately raise or lower the wire lifting arms 87 and 88.

As described above the emergency stop panel 40 pivotally hangs from its support bar 41. An enlarged view of the left side of the emergency stop panel 40 is shown in FIG. 4. Referring thereto, the laterally projecting lever arm 40*b* has an opening therein through which operating lever 110*a* of an emergency stop switch 110 projects. The emergency stop switch is secured to the chassis 12 at a position generally above the guide roller 34. The emergency stop switch comprises a hydraulic safety control valve, hereinafter described in more detail, that is operable in a "run" condition when its operator lever 110*a* is pulled out as illustrated in FIG. 5, to operatively circulate hydraulic fluid within the closed hydraulic system to the motor 118 that rotates drive roller 50, and in a "stop" or "safe" condition, when its operator lever 110*a* is pushed in, to divert hydraulic fluid from the drive motor 118 for roller 50, causing roller 50 to stop. The operating lever arm 110*a* has an enlarged pad member 110*b* secured to it which is aligned with the lever arm 40*b* of the emergency stop panel such that the lever arm 40*b* will engage and apply force to the pad 110*b* so as to activate the emergency stop switch 110 to its "stop" mode of operation by pushing in the operating lever arm 110*a*, when the emergency stop panel 40 is pushed inwardly in the direction of the arrow "S" in FIG. 4. The emergency stop panel 40 is maintained at a position as limited by a retaining clip 40*c* (see FIG. 1) by a spring 97 (FIG. 5) such that the lever arm 40*b* lies adjacent to but does not touch the pad 110*b* of the emergency stop switch 110 when the operating lever 110*a* is pulled fully out to its "run" condition. When the emergency stop panel 40 is pushed, causing the operator lever 110*a* to activate switch 110 in its "stop" or "safe" mode, switch 110 will remain in such "safe" mode until the safety switch 110 is manually reset by pulling the operator lever 110*a* outward (FIG. 5) by the operator reset knob 110*c*.

The primary power source for the wire straightening device is an internal combustion engine generally designated at 100 (FIG. 3). In the preferred embodiment, the engine used is a eight horsepower internal combustion engine manufactured by Honda Corporation which operates at an average speed of 3400 rpm. The engine 100 is mechanically coupled to and drives a hydraulic pump 106 which hydraulically controls the entire operation of the wire straightening apparatus in a fail-safe manner. If the hydraulic pressure should fail, or if the emergency stop safety switch is activated, the drive roller 50 instantaneously stops rotating.

Figure 7:
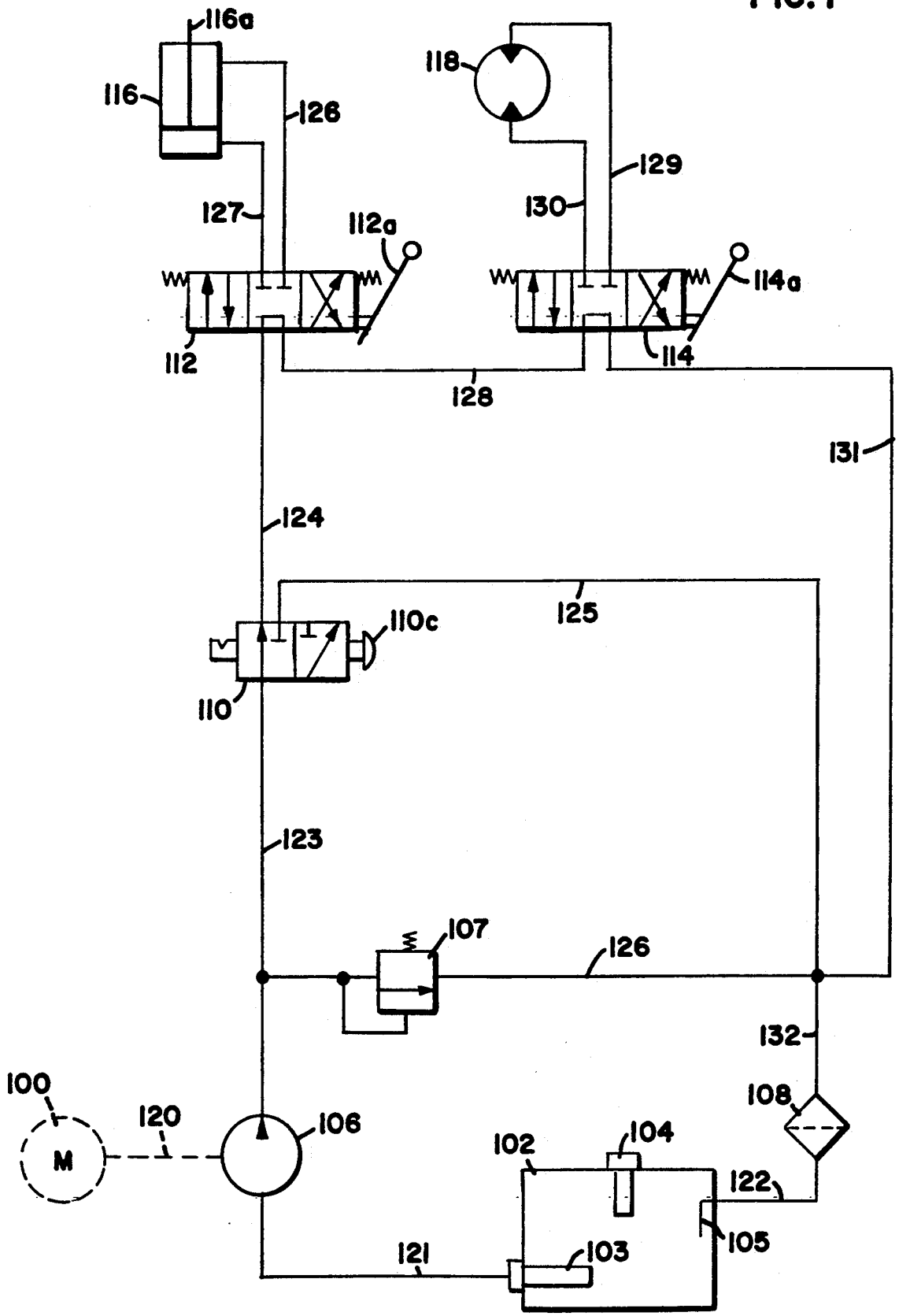
FIG. 7 is a hydraulic schematic diagram illustrating the hydraulic operating system of the mesh straightening apparatus of FIG. 1.

A schematic diagram of the hydraulic circuit of the wire mesh straightening apparatus of the preferred embodiment is illustrated in more detail in FIG. 7. Referring thereto, the internal combustion engine 100 operatively drives the pneumatic pump 106 by means of a mechanical coupling illustrated by the dashed line 120. In the preferred embodiment, the pump 106 is a type lP-3020-CPSJB hydraulic gear pump manufactured by Dowty Industrial Corporation that is operable to pump hydraulic fluid from its inlet port to its outlet port proportionately with the speed of its mechanical drive from the engine 100. The pump 106 pumps hydraulic fluid from a hydraulic fluid reservoir 102 through a strainer 103 and a hydraulic line 121. The reservoir 102 is also illustrated in the schematic as having a filler port 104 and a return defuser element 105 that receives return flow from the closed hydraulic system through a filter 108 and a hydraulic line 122. In the preferred embodiment the filter 108 is of a type F4E030#3 manufactured by Purolator Inc.

The pump 106 pumps hydraulic fluid from the reservoir 102 in proportion to the drive speed of the motor 100, and provides hydraulic fluid to the safety control valve 110 by means of a hydraulic line 123. In the preferred embodiment, the safety control valve 110 is a ball check type MV-04 selector valve manufactured by Metro Hydraulics which is operable, as described above, in either a "run" or "safe" position In its "run" position as illustrated in the schematic diagram of FIG. 7, switch 110 directs hydraulic oil received from line 123 at its input port to hydraulic line 124. When activated, as described above, to its "safe" mode or position, the switch's internal spool redirects the incoming hydraulic fluid to the hydraulic line 125 which returns the fluid back to the reservoir 102 through the filter 108.

The pump 106 also provides hydraulic fluid to the inlet port of a hydraulic pressure relief valve 107. In the preferred embodiment, the relief valve is a type RL-50-1500PSI valve manufactured by Brand Hydraulics and is operable to sense the pressure at its inlet port Valve 107 is normally "closed" to enable pump 106 to direct fluid flow through line 123 to the safety switch 110 and is operable to "open" in the event that its input pressure exceeds a predetermined value, to return hydraulic fluid back to the reservoir 102 by means of the hydraulic line 126. In the preferred embodiment, the relief valve 107 is designed to maintain the hydraulic line pressure at a maximum of 1500 psi. The typical line pressure within the system of the preferred embodiment varies between 1000 and 1300 psi.

When normally operative in a "run" mode the safety switch 110 directs hydraulic fluid by means of the hydraulic line 124 to the inlet port of a hydraulic control valve 112. In the preferred embodiment, the control valve 112 is a four-way pressure compensated flow control valve manufactured by Brand Hydraulics and is of a type SDCF-755-TM6-4LS. The valve 112 has an operator lever, generally designated at **112*a* that is spring-centered and has a neutral center position and is operable to selectively direct hydraulic fluid received at its inlet port from hydraulic line 124 to either the hydraulic line 126 or the hydraulic line 127, with the other of the two serving as the return line for the closed system. The spring-centered feature returns the valve spool to a neutral position whenever the operating lever is released. The hydraulic lines 126 and 127 are connected to the hydraulic piston 116 which powers the wire roll lifting feature previously described. The hydraulic cylinder 116 is power driven in both directions to raise or lower the lifting arms 87 and 88 through the camming structure previously described. When the operating lever 112*a* of valve 112 is not actuated so as to direct fluid flow to the lines 126 and 127, fluid applied to the inlet port of valve 112 is automatically directed by means of the hydraulic line 128 to the inlet port of a second hydraulic valve 114**.

Hydraulic control valve 114 is in the preferred embodiment identical to valve 112, and is operable to selectively direct hydraulic fluid applied to its inlet port to either the hydraulic line 129 or the hydraulic line 130, with the second of the two lines serving as the return path for the hydraulic fluid, which is directed by valve 114 back to the reservoir 102 by means of the return line 131. The hydraulic lines 129 and 130 are connected to selectively energize the hydraulic motor 118 in either of two directions, depending upon the operator selection provided by means of the valve operating lever **114*a*. The hydraulic motor 118 is, in the preferred embodiment, a general purpose low speed high torque hydraulic motor manufactured by Eaton Corporation under its Char-Lynn ® trademark and is a type 101-1040 motor. An operator would normally move the valve lever 114*a* in a direction so as to cause the drive roller 50 to rotate in a clockwise direction as viewed in FIG. 5, so as to advance wire mesh through the wire straightening apparatus. The "reverse" feature, however, enables rotation of the drive roller 50** to be reversed in case of emergency or should a malfunction or jamming of the straightening apparatus occur.

Referring to FIG. 1, the reservoir 102 is generally illustrated as mounted near the top of the apparatus adjacent the pump 106 and the motor 100. The filter 108 is mounted to the side of the reservoir 102. As previously described, the safety switch 110 is mounted near the left side of the emergency stop panel 40. The pressure relief valve 107 is not physically illustrated in the figures, but lies adjacent to the pump 106. Referring to FIG. 3, most of the operator controls are positioned so as to be controlled by an operator while he is standing adjacent the forward end of the apparatus as illustrated in FIG. 3 where he is safely out of the way of the advancing wire mesh being drawn into the inlet port 32 and where he can clearly view the wire feeding process as well as the wire leaving the apparatus. As previously described, the operator lever 74 for controlling positioning of the upper roller 55 is located adjacent the left side of the forward end as addressed by an operator. The engine 100 is mounted to the chassis near the top thereof so as to be in mechanical alignment with the pump 106 and close to the reservoir 102. The control valves 112 and 114 and their associated operator levers **112*a* and 114*a* are mounted adjacent the engine 100 for ease of operation of all three, as well as the lever 74**, by an operator standing at one position which is remote from the inlet feed port of the apparatus.

The entire apparatus is fairly compact and, as previously described, can be towed by a motor vehicle and maneuvered in dolly or wagon-like fashion by an operator at the construction site by means of the caster wheel assembly. When not in use, the entire apparatus can be lifted if so desired by a crane into the bed of a pickup truck by means of a lifting bracket 150, illustrated best in FIG. 1.

The entire wire straightening apparatus can be operated by one person. A roll of wire mesh 160 to be straightened is positioned between the lifting arms 87 and 88, with the free end of the wire roll positioned near the "top" of the roll so as to address the inlet feed port 32 of the apparatus, as illustrated in FIG. 1. A dowel or bar 162 is then slid through the center opening of the wire mesh roll 160 and is positioned within the U-shaped end portions of the lifting arms 87 and 88, as illustrated in FIG. 1. The operator then grasps the handle 84 of the wire engaging and feed mechanism and pulls the handle out against the bias of spring 86, and lowers the handle and tubular arm **85*a* to engage the lower hook 84*a* of the handle 84 with the wire mesh to be straightened. As the operator releases tension on the lever 84, the spring 86 will pull the mesh toward the inlet feed port 32 and maintain the pressure on the engaged wire mesh roll to automatically urge the wire mesh roll toward the inlet feed port and the drive roller 50 without further operator intervention. Once the wire mesh feed lever is thus engaged, the operator can walk around to the front or forward end of the apparatus without fear of becoming entangled with or engaged by the wire mesh to be straightened. He can start the engine 100, and raise the engine to its desired rpm operating level, which automatically pressurizes the hydraulic system of the apparatus by means of the pump 106. By appropriately operating the lever 112*a* of the control valve 112, the hydraulic cylinder 116 can be selectively energized to raise the lifting arms 87 and 88 and the attached wire mesh roll to an operating level such as illustrated in FIGS. 2 and 3**. The apparatus is now ready for activation of the roller structure.

By raising the lever 74, the operator places the upper roller 55 into proximity with the lower roller 50, forming a nip line therebetween. The separation distance between the surfaces of the upper and lower rollers is established by preadjustment of the adjustment brackets 62 and 66 as described above. Once the lever 74 is set in its upper "rest" position, it is generally left in that position for an entire straightening project which may involve a plurality of mesh rolls. The handle 74 would typically only be "tripped" to its lowered position in the event of an emergency that required immediate lifting of the upper roller 55. By moving the control lever 114*a* of the control valve 114, the operator energizes the hydraulic motor 118, causing the drive roller 50 to rotate in the direction indicated in FIG. 5. As urged by the engaged feed lever 84, the end of the wire mesh is forced toward the nip, engages the rubberized surface of the feed roller 50 and is pulled between and flattened by the nip formed by the drive roller 50 and the upper roller 55. The upright guide rollers 34 and 36 safeguard against lateral shifting of the wire mesh being fed to the inlet port 32. As the wire mesh is drawn into the straightening apparatus, the automatic feed lever apparatus 84, 85 is pulled by means of the spring 86 back into its retracted position illustrated in FIG. 5, and the hook member 84*a* automatically releases from the engaged mesh as the engaged portion thereof advances into the inlet port 32 of the apparatus. The pressure applied by the upper roller against the wire mesh as it proceeds through the nip area between the rollers, flattens any kinks or bends in the lateral plane of the wire as it passes through the nip area. Once the wire mesh passes through the nip area, it engages the upper surface of the shelf or plate member 79 (as illustrated in FIG. 2) and is bent upward in a direction opposite to the curvature of the wire as it leaves the roll 160, thereby straightening the wire. The angle of the reaction force applied to the wire mesh by the plate member 79 can be controlled by adjusting the vertical support brackets 81 and 82 so as to raise or lower the distal end of the plate 79 as desired. This adjustment is typically made in advance of operating the apparatus, based upon predetermined knowledge as to the proper height of the distal end that is needed to achieve the desired bend in the wire being handled so as to completely straighten the wire. The straightened wire simply drops by gravity to the construction bed where it is to be used as it exits from the straightening apparatus, and can be advanced along the ground if needed by a second operator. The straightening apparatus of this invention provides for straightening of an entire roll of wire mesh, including the very end of the roll which heretofore has been typically discarded as waste.

In the unlikely event that a foreign object or perhaps second person (other than the control operator) were to get entangled in the wire mesh being fed into the inlet port of the machine, the endangered person can "immediately" stop the drive roller 50 by simply pushing the emergency stop panel at the inlet port 32 inward, to activate the emergency stop switch 110. Once activated, the emergency stop switch 110 will not allow the drive roller 50 to receive power from the motor 118 until the emergency stop switch 110 as been manually reset. The "hydraulic" nature of the system provides for "instantaneous" reaction of the safety stop feature, that is not easily attained with nonhydraulic mechanisms that use mechanical spring or throw-out mechanisms. Also, a hydraulic type of system is generally more liable than mechanical counterparts over extended periods of use. If the operator desires to reverse operation of the roller 50*a* for any reason, he can do so by simply toggling the lever arm 114*a* in the opposite direction so as energize the hydraulic motor 118 in reverse, thus reversing the direction of rotation of the drive roller 50. Further, any failure, leak or malfunction in the closed hydraulic system used to power the system will automatically result in a fail-safe condition that is safe to the operator.

While a preferred embodiment of the invention has been described which clearly illustrates the principles and concepts of this invention, it will be understood by those skilled in the art that many other variations of the invention and the use of other components and parts or designs therefor may be employed without departing from the spirit and scope of this invention. As an example, but not by way of limitation, a wire cutting apparatus could readily be installed on the apparatus for automatically cutting the straightened wire to desired lengths. The above-described preferred embodiment has been provided to illustrate one example of a possible embodiment that incorporates and practices the principles of the present invention. Other modifications and alterations thereof are well within the knowledge of those skilled in the art and are to be included within the broad scope of the appended claims.

What is claimed is:

1. Wire mesh straightening apparatus for automatically straightening rolled wire mesh at a construction site, comprising:

(a) a chassis sized and configured for ease of mobility to and at a construction site;

(b) a pair of generally parallel rollers mounted to said chassis and cooperatively aligned generally parallel to each other and forming a nip between those respective surface portions of said rollers that lie closest to one another at any point in time, said rollers having a length at least equal to the width of the wire mesh to be straightened;

(c) means for advancing the wire mesh to be straightened through said nip formed by said rollers including hydraulic drive means operatively connected to drive at least one of said rollers about its axis;

(d) reaction means connected to said chassis arranged and configured to intercept the wire mesh passing through said nip for continuously bending said mesh in a direction opposed to the preexisting curvature of said wire mesh as it leaves said nip; whereby said wire mesh is uniformly straightened as it leaves said reaction means; and (e) self-releasing starting means connected to said chassis for retainably engaging the wire mesh to be straightened and for guiding the mesh toward said nip.

2. The apparatus as recited in claim 1, further including biasing means operatively connected to at least one of said rollers for urging said one roller toward engagement with the other of said rollers.

3. The apparatus as recited in claim 1, further including quick release means operatively connected to one of said rollers for selectively rapidly moving that roller away from the other of said rollers, thereby removing the nip formed between the pair of rollers.

4. The apparatus as recited in claim 1, further including stop adjustment means cooperatively operable with said rollers for adjustably setting the distance between said rollers along said nip.

5. The apparatus as recited in claim 1, wherein said power driven roller has a resilient surface.

6. The apparatus as recited in claim 1, wherein said reaction means includes a plate member mounted to said chassis adjacent said nip, said plate member defining a reaction surface for engaging and bending said wire mesh as it leaves said nip, said reaction means being operative to bend the wire mesh in a direction opposed to the angle of incidence of the wire mesh relative to the plate member.

7. The apparatus as recited in claim 6, including means for varying the angle of incidence of the wire mesh relative to the plate member, wherein the degree of bending imparted to the wire by said reaction means can be adjusted.

8. The apparatus as recited in claim 1, further including safety means operatively connected with said means for advancing the wire mesh to be straightened, for instantaneously halting the advance of the wire mesh in response to an operator initiated safety stop signal.

9. The apparatus as recited in claim 8, wherein said means for advancing the wire mesh comprises a closed loop hydraulic control system having a safety stop switch in circuit therewith.

10. The apparatus as recited in claim 1, wherein said self-releasing starting means includes a spring-biased hook member arranged and configured to retainably engage and urge the wire mesh in the direction of spring bias force and to automatically release said mesh when mesh movement causes the spring bias exerted on the mesh to approach zero.

11. The apparatus as recited in claim 1, further including means on said chassis for holding a roll of the mesh to be straightened in generally parallel manner with said rollers such that the wire is removed from the top of the roll and is removed from the roll at a height that cooperatively addresses and is generally aligned with said nip.

12. The apparatus as recited in claim 11, wherein said mesh holding means comprises power lift means for selectively raising and lowering a roll of wire mesh to an operator desired height.

13. The apparatus as recited in claim 1, wherein said chassis is mounted on an axle supported by a pair of wheels for ease of mobility on the ground.

14. The apparatus as recited in claim 13, further including a caster wheel mounted to said chassis for enabling dolly-like movement of said apparatus.

15. The apparatus as recited in claim 14, further including adjustable leveling means operatively connected with said caster wheel for adjusting the angle of the roller axes relative to the ground.

16. The apparatus as recited in claim 13, further including locking brake means for preventing movement of said chassis relative to the ground when operatively straightening the wire mesh.

17. The apparatus as recited in claim 1, wherein the axes of said pair of rollers are not in exact vertical alignment with one another.

18. The apparatus as recited in claim 1, wherein the axes of said pair of rollers are spaced from one another in both the vertical and horizontal directions, and wherein the uppermost roller has a smaller diameter than the lowermost roller.

19. The apparatus as recited in claim 1, wherein said wire mesh advances toward said nip through an inlet port of said chassis; and wherein said means for advancing said wire mesh includes operator controls located on a side of said chassis other than that side on which said inlet port is located; whereby an operator of said controls stands safely clear of the advancing wire mesh entering said inlet port.

20. The apparatus as recited in claim 1, further including a pair of spaced guide rollers mounted on generally vertical axes at opposite sides of said nip for continuously guiding the advancing wire mesh into said nip.

21. Wire mesh straightening apparatus for automatically straightening rolled wire mesh at a construction site, comprising:

(a) a chassis sized and configured for ease of mobility to and at a construction site;

(b) a pair of generally parallel rollers mounted to said chassis and cooperatively aligned generally parallel to each other and forming a nip between those respective surface portions of said rollers that lie closest to one another at any point in time, said rollers having a length at least equal to the width of the wire mesh to be straightened;

(c) means for advancing the wire mesh to be straightened through said nip formed by said rollers;

(d) reaction means connected to said chassis arranged and configured to intercept the wire mesh passing through said nip for continuously bending said mesh in a direction opposed to the preexisting curvature of said wire mesh as it leaves said nip; whereby said wire mesh is uniformly straightened as it leaves said reaction means;

(e) safety means operatively connected with said means for advancing the wire mesh to be straightened, for instantaneously halting the advance of the wire mesh in response to an operator initiated safety stop signal; and (f) self-releasing starting means connected to said chassis for retainably engaging the wire mesh to be straightened and for guiding the mesh toward said nip.

22. Wire mesh straightening apparatus for automatically straightening rolled wire mesh at a construction site, comprising:

(a) a chassis sized and configured for ease of mobility to and at a construction site;

(b) a pair of generally parallel rollers mounted to said chassis and cooperatively aligned generally parallel to each other and forming a nip between those respective surface portions of said rollers that lie closest to one another at any point in time, said rollers having a length at least equal to the width of the wire mesh to be straightened;

(c) means for advancing the wire mesh to be straightened through said nip formed by said rollers;

(d) reaction means connected to said chassis arranged and configured to intercept the wire mesh passing through said nip for continuously bending said mesh in a direction opposed to the preexisting curvature of said wire mesh as it leaves said nip; whereby said wire mesh is uniformly straightened as it leaves said reaction means; and (e) self-releasing starting means for retainably engaging the wire mesh to be straightened and for guiding the mesh toward said nip.

23. The apparatus as recited in claim 22, wherein said self-releasing starting means includes a spring-biased hook member arranged and configured to retainably engage and urge the wire mesh in the direction of spring bias force and to automatically release said mesh when mesh movement causes the spring bias exerted on the mesh to approach zero.

24. A method of straightening rolled wire mesh by a self-contained mobile apparatus comprising:

(a) positioning a roll of wire mesh to be straightened adjacent and in generally parallel manner to a pair of generally horizontal rollers cooperatively arranged to form a nip therebetween such that the wire unrolls from the top of the roll;

(b) lifting the roll of positioned wire mesh from the ground and such that the wire leaving the roll is generally aligned with said nip, without requiring bending of the wire to enter the nip;

(c) retainably engaging said wire mesh of said roll by means of a self-releasing starting means and guiding said wire mesh thereby toward said nip;

(d) continuously advancing the wire through the nip by hydraulically rotating at least one of said rollers; thereby removing kinks and irregularities therefrom; and (e) continuously bending the wire advanced through said nip in a direction opposed to the direction of travel of said wire from said nip, thereby straightening said wire.

25. The method as recited in claim 24 wherein the step of lifting the roll of wire mesh is performed by a power driven lifting arm.

26. A method of automatically continuously straightening rolled wire mesh, comprising the steps of:

(a) horizontally arranging a roll of wire mesh to be straightened such that the wire will be unwound from the top of the roll;

(b) guiding the wire mesh unwound from the roll through a nip formed by a pair of cooperatively arranged rollers;

(c) compressively engaging the wire mesh between said rollers at said nip;

(d) rotating at least one of the rollers by means of a closed hydraulic power system thereby advancing the wire mesh through the nip;

(e) directing the advancing wire mesh from said nip toward a reaction surface;

(f) continuously pushing said directed wire mesh against and along said reaction surface mounted at a predetermined angle relative to the advancing wire mesh, thereby imparting a reverse curvature to said wire mesh generally opposite to that which it retained upon removal from said roll; and (g) automatically stopping rotation of said one roller upon a pressure failure in said hydraulic system.

27. The method as recited in claim 26, further including the step of adjusting the angle of said reaction surface relative to the advancing wire mesh so as to impart a reverse curvature to the wire mesh that is generally equal and opposite to that which it retained upon removal from said roll, thereby straightening said wire mesh.

28. The method as recited in claim 26, including the step of safely controlling the rotation of said roller by means of controls located at a position unaligned with the rollers or the advancing wire mesh, such that an operator of such controls is not endangered by the rollers or advancing wire.

29. The method as recited in claim 26, wherein the step of guiding the wire mesh from said roll through the nip includes the steps of engaging the wire mesh by means of a spring-biased hook and automatically urging the wire mesh toward said nip by said spring-biased hook prior to rotating said one roller.

* * * * *